United States Patent [19]

Kortick

[11] 4,387,641

[45] Jun. 14, 1983

[54] LABEL PRINTING APPARATUS

[75] Inventor: Morris Kortick, Cranston, R.I.

[73] Assignee: A & H Mfg. Co., Johnston, R.I.

[21] Appl. No.: 299,002

[22] Filed: Sep. 3, 1981

[51] Int. Cl.[3] ..... B41F 1/06

[52] U.S. Cl. ..... 101/27; 101/292; 101/332

[58] Field of Search ..... 101/27, 41, 44, 324, 101/332, 68, 102, 107, 21, 288, 292

[56] References Cited

U.S. PATENT DOCUMENTS

| | | | |
|---|---|---|---|
| 2,356,951 | 8/1944 | Runton | 101/27 |
| 3,120,177 | 2/1964 | Clark | 101/332 |
| 3,128,692 | 4/1964 | Talarico | 101/27 |
| 3,316,835 | 5/1969 | Liepelt | 101/27 |
| 3,430,557 | 3/1969 | Peters | 101/27 |
| 3,540,375 | 11/1970 | Alton | 101/292 |
| 3,902,409 | 9/1975 | Filsinger et al. | 101/27 |
| 4,048,913 | 9/1977 | Navi | 101/27 |
| 4,077,187 | 3/1978 | Paxton | 101/27 |
| 4,257,328 | 3/1981 | Gavit | 101/292 |
| 4,263,766 | 4/1981 | Baker et al. | 101/44 |

*Primary Examiner*—William Pieprz

*Attorney, Agent, or Firm*—Salter & Michaelson

[57] ABSTRACT

An apparatus for thermographically printing a succession of labels or the like is disclosed. A continuous strip of labels is stepwisely fed by a label feed assembly to a printing pad at a printing station, while a conventional thermographic strip is simultaneously stepwisely fed thereto so that the strip overlies a label at the station. A heated print head having various type elements engages the thermographic strip for urging it against the label at the station to effect printing. The print head is part of a printing assembly and is operated through parallel linkage arms which maintain it substantially parallel to the pad and thereby provide even pressure over the printing surface during the printing apparatus. The printing assembly, the label feed assembly and the thermographic strip feed assembly are all mechanically driven through a drive assembly to provide positive coordination in their operation.

6 Claims, 15 Drawing Figures

LABEL PRINTING APPARATUS

BACKGROUND AND SUMMARY OF THE INVENTION

The instant invention relates to the printing of labels, tags and the like and more particularly to a novel apparatus for printing a succession of labels, tags or the like.

The use of preprinted labels is obviously widespread and extends to the marketing of virtually all types of goods. In this regard manufacturers, wholesalers and large retailers frequently have need for large quantities of labels bearing the same imprint; and hence in recent years several machines have been developed for printing such labels in rapid succession. Machines of this type representing the closest prior art of which the applicant is aware are disclosed in the U.S. patent to BURTON, U.S. Pat. No. 3,655,492; SMITH, U.S. Pat. No. 3,662,681; SEIDL et al., U.S. Pat. No. 3,908,544 and SEIDL et al., U.S. Pat. No. 4,027,590. Broadly all of these machines operate by advancing strips of interconnected tags, labels or the like to a printing station where the labels are printed in relatively rapid succession.

The apparatus of the instant invention operates in this same general manner, advancing interconnected labels, tags or the like to a printing station for printing. However, in contrast to the previously known machines of this general type, the apparatus of the instant invention incorporates a mechanically driven print head which always remains substantially parallel to a printing pad at the printing station to provide even printing pressure over the printing surface. Parallel linkage arms which are pivotally connected to the print head and to a substantially vertical support frame operate to cyclically advance the print head to the printing pad to effect printing. The linkage arms which comprise both primary and secondary arms extend generally over the printing pad to position the print head for printing. The primary or driving arms also extend rearwardly from the support frame providing leverage to drive the linkage arms in the print head assembly. Manipulation of the print head assembly is effected through a mechanical drive assembly which operates to cyclically advance the print head toward the printing pad. Substantial leverage provided by the rearwardly extending portions of the primary arms effects desired printing pressures while the head is maintained substantially parallel to the pad through the cooperation of the primary and secondary arms to permit high resolution printing.

While the apparatus herein disclosed is adaptable for various types of printing operations including ink printing and embossed printing, it is particularly suited for thermographic printing operations. In this connection the print head of the apparatus herein disclosed includes a heating element for heating the type elements for thermographic printing. In addition the apparatus includes a thermographic strip feed assembly which operates to stepwisely advance a conventional thermographic foil strip to the printing station during the non-printing portions of the printing cycles. Accordingly, when the heated type elements are advanced to effect printing, they engage the strip pressing it against a label or tag at the station to effect printing. Although this general type of thermographic printing operation is relatively well known, the label printing machines heretofore available have been generally incapable of consistently effecting high resolution thermographic printing. By incorporating a mechanically driven print head which remains substantially parallel to the printing pad and a parallel linkage arm printing assembly, the apparatus herein disclosed is capable of consistently effecting high resolution printing and therefore represents a significant advancement in thermographic label printers.

The clarity or resolution of a printed image has particular significance in OCR (optical character recognition) labeling systems such as where labels are machine read in computer inventory or pricing systems. In this connection, character widths must be within tolerances of 11 to 14 one thousands of an inch (0.011–0.014 inch) to be read by conventional character recognition equipment or the label will be rejected as unreadable. High rates of label rejection in these systems resulting from poorly printed labels have frequently been the source of substantial accounting errors. Unfortunately, the characters utilized in OCR systems are relatively confusing for operators to read visually. Hence when the poorly printed labels are rejected by the OCR reader, substantial errors are frequently introduced through operator error. The apparatus of the instant invention has consistently proven to be capable of printing OCR quality labels in thermographic printing oeprations, and thereby effectively eliminates this problem.

The drive assembly of the apparatus herein disclosed also has significant advantages over drive assemblies of the previously known machines by effectively assuring optimum coordination between the printing assembly, the label feed assembly and the thermographic strip feed assembly. Operation of the printing assembly is effected through a cam mounted on a drive shaft which is rotated by a drive motor and which communicates through a cam follower frame with the primary linkage arms to advance the print head toward the printing pad. The feed mechanism which operates to stepwisely advance the tags or labels is also driven through mechanical linkage by the same drive motor to provide a direct mechanical relationship between the printing and feeding assemblies. The thermographic strip assembly is similarly mechanically driven by the drive motor to ensure proper timing of strip advancements in relation to print head movement. The printing assembly, the label feed assembly and the strip feed assembly are all independently mechanically adjustable in this regard so that proper timing can always be achieved regardless of label size or other variables.

Accordingly, the primary object of the instant invention is to provide an apparatus for effecting high resolution printing of labels, tags and the like in rapid succession.

Another object of the instant invention is to provide a high resolution thermographic label printing apparatus.

A still further object of the instant invention is to provide a label printing apparatus having a mechanically driven print head which remains substantially parallel to the printing pad throughout the printing operation.

Other objects, features and advantages of the invention shall become apparent as the description thereof proceeds when considered in connection with the accompanying illustrative drawings.

DESCRIPTION OF THE DRAWINGS

In the drawing which illustrates the best mode presently contemplated for carrying out the present invention.

DESCRIPTION OF THE INVENTION

Figure 1:
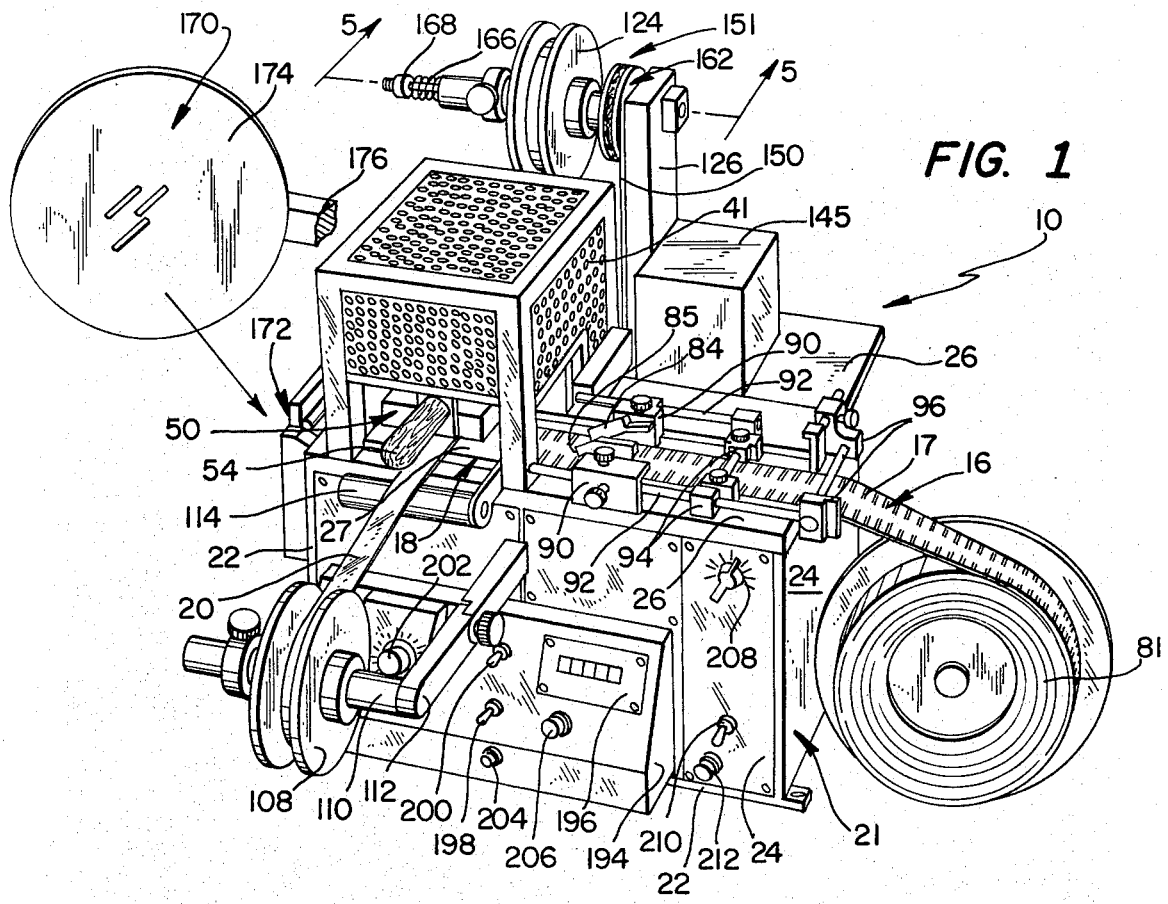
FIG. 1 is a perspective view of the apparatus of the instant invention.

Referring now to the drawings, the apparatus of the instant invention is generally indicated at 10 in FIGS. 1 through 4 and generally comprises a printing assembly generally indicated at 12, a label feed assembly generally indicated at 13, a thermographic strip feed assembly generally indicated at 14 and a drive assembly generally indicated at 15. In operation, a label strip 16 which comprises a plurality of interconnected labels 17 is stepwisely advanced by the feed assembly 13 to an area herein designated as a printing station 18 while a thermographic strip 20 is simultaneously stepwisely advanced to the station 18. Sequential imprinting of the labels 17 is effected at the printing station 18 with the printing assembly 12 as it is mechanically driven by the drive assembly 15, causing various type elements to engage the strip 20 to effect printing with selective pressurized engagement of the strip 20 with the labels 17.

Figure 2:
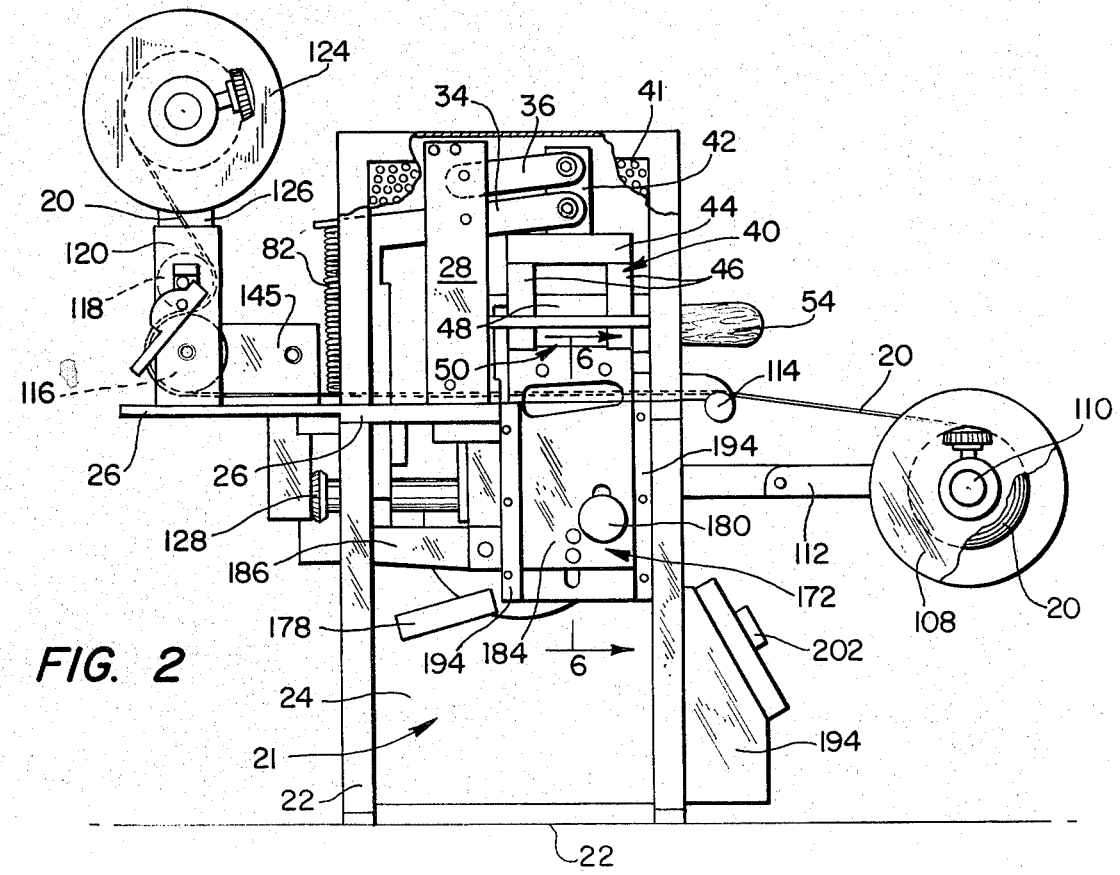
FIG. 2 is a side elevational view thereof with portions of the housing broken away.
Figure 4:
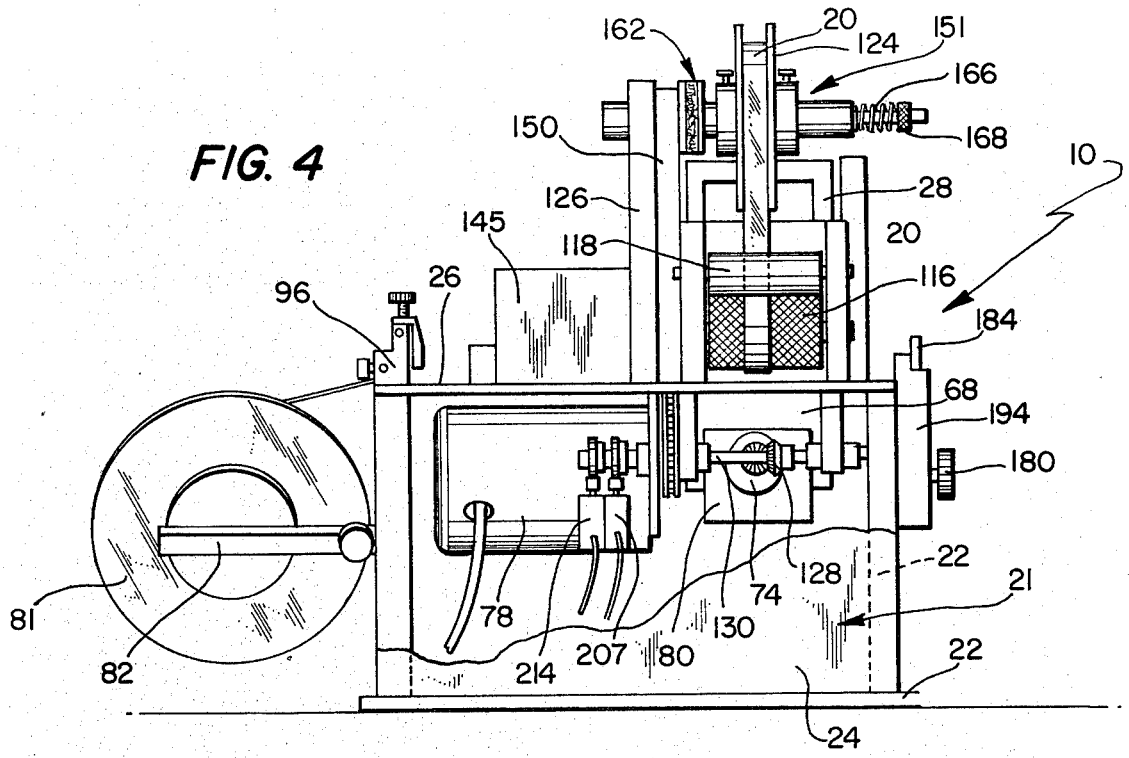
FIG. 4 is a rear elevational view of the apparatus with portions of the housing broken away.

Referring first particularly of FIGS. 1, 2 and 4, it will be noted that the apparatus 10 includes a base 21 of substantially rectangular section which is defined by a frame 22 having wall panels 24 and a top plate 26 attached thereto. The base 21 provides a housing for various elements of the assemblies 12, 13, 14 and 15 and provides support for a printing pad 27 which supports the labels 17 at the station 18 during printing. In this connection in the embodiment herein disclosed the pad 27 is merely a flat plate which supports the labels 17 at the station 18. In other embodiments the pad 27 may be adapted as necessary while still functioning primarily to support the labels 17 at the station 18.

The printing assembly 12 is attached to the base 21 and operates to effect the printing function in the apparatus 10 as the labels 17 are advanced with the label feed assembly 13. Specifically, the print assembly 12 includes a substantially vertical support frame 28 which extends upwardly from the plate 26 and which has primary and secondary parallel linkage arms 34 and 36 pivotally attached thereto. The arms 34 and 36 both extend generally forwardly in substantially parallel spaced relation over the print station 18 with the primary arms 34 also extending rearwardly and being connected with a cross member 38. The arms 34 and 36 effect the printing operation in the apparatus 10 by advancing a printing head 40 disposed within a housing 41 toward the printing pad 27 at the station 18. In this regard the forward ends of the arms 34 and 36 are pivotally attached to substantially vertical print head members 42 which extend upwardly from the head 40. The cooperation of the arms 34 and 36 with the frame 28 and the members 42 acts to effectively maintain the head 40 substantially parallel to the pad 27 throughout the printing cycle. As a result, even pressure is maintained over the entire printing surface to permit accurate high resolution printing which was virtually impossible with the previously known thermographic label printing machines.

Figure 7:
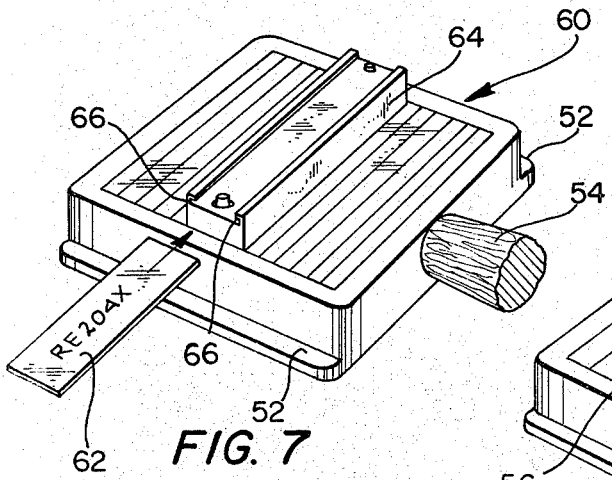
FIG. 7 is a perspective view of a type chase of the apparatus of the instant invention which includes a photoetched type element plate.
Figure 8:
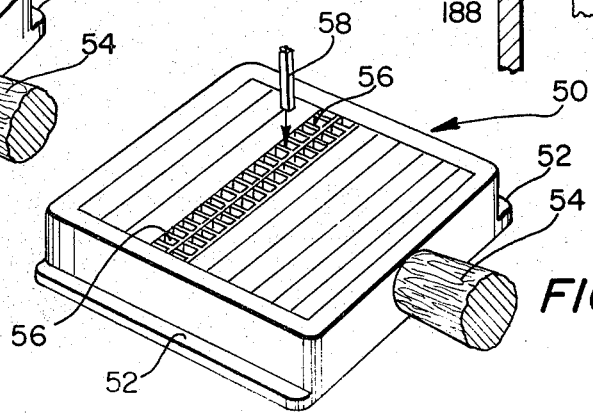
FIG. 8 is a perspective view of a type chase which includes individual type stick elements.
Figure 9:
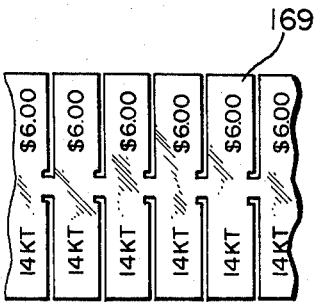
FIGS. 9 through 13 illustrate various types of labels and tags printed by the apparatus of the instant invention.
Figure 10:
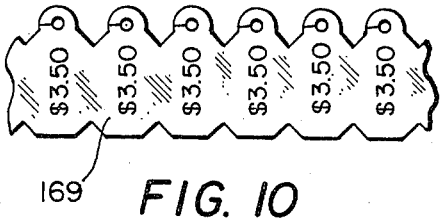
Figure 11:
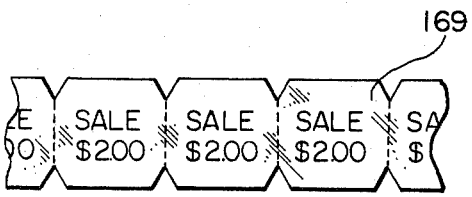
Figure 12:
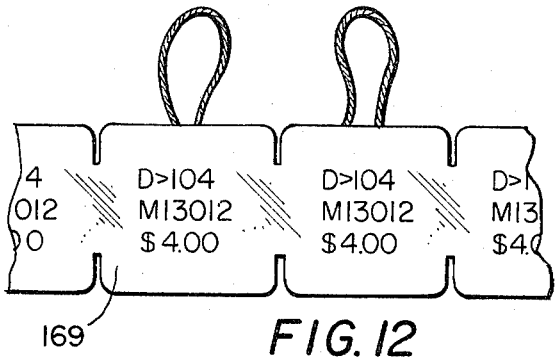
Figure 13:
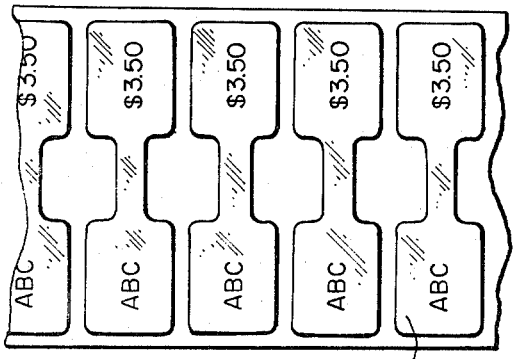
Figure 14:
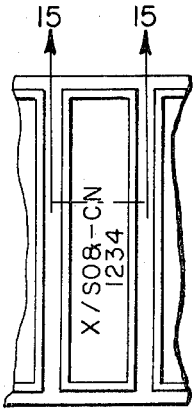
FIG. 14 is a top plan view of an embossed label as printed by an alternative embodiment of the instant invention.
Figure 15:
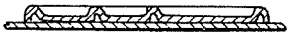
FIG. 15 is a sectional view taken along line 15—15 in FIG. 14.

While it is understood that the apparatus of the instant invention is adaptable for various types of printing operations, the embodiment herein disclosed comprises a thermographic printing apparatus; and hence the print head 40 is adapted accordingly. As will be seen from FIG. 2, the print head 40 includes both a top plate 44 to which the members 40 are attached and downwardly extending corner posts 46 having substantially horizontal inwardly directed channels (not shown) adjacent to their lower ends. A substantially rectangular heater block 48 having a variable internal heating element is attached to the posts 46 in substantially horizontal disposition immediately above the channels therein. A type chase 50 of the general configuration illustrated in FIG. 8 having side flanges 52 and a handle 54 provides means for retaining actual type elements in the print head 40. In this connection the chase 50 is detachably secured in the head 40 with the flanges 52 in the channels in the posts 46 positioning the chase 50 in substantially horizontal disposition and in intimate engagement with the heater block 48 to effect heating of the type elements for thermographic printing. As will be seen from FIG. 8, the chase 50 defines a print frame having a plurality of aligned slots 56 which receive and retain individual type stick elements 58. Other chase constructions may be of the type illustrated in FIG. 7 and generally indicated at 60, wherein a photoetched magnesium plate 62 which comprises the type element is retained in a bracket 64 having channels 66.

In operation the print head 40 reciprocally moves up and down to effect printing of the labels 17 with the various type elements in the chase 50. This reciprocal motion is effected with the drive assembly 15 through a substantially vertical cam follower frame 68. The cam follower frame 68 communicates up and down movement to the cross member 38 through a threaded adjustment screw 70 which engages the frame 68 as at 72. The frame 68 is of generally rectangular configuration and is slidingly mounted with suitable conventional means (not shown) for reciprocal up and down movement in the apparatus 10 riding on a cam 74 which is mounted on a primary drive shaft 76. Accordingly, up and down motion of the head 40 is effected through arms 34 and 36, and the frame 68 as the cam 74 and the shaft 76 are rotated by means of a motor 78 having a gear box 80. This operation is further promoted by a spring 82 which extends between the plate 26 and the member 38 to bias the member 38 toward the frame 68 and the frame 68 toward the cam 74. The limit of the downward travel of the head 40 may be adjusted by manipulation of the adjustment screw 70.

The label feed assembly 13 is also mechanically driven by the motor 78 and operates to stepwisely advance the labels 17 for printing at the print station 18. In this connection the feed assembly 13 includes a feed roll 81 mounted on a bracket 82 to supply the unprinted labels 17 to the printing assembly 12. The feed assembly 13 further includes feed fingers 84 which are slightly downwardly biased and directed generally toward the print station 18 and which reciprocate horizontally, engaging the individual labels 17 as at 84 to effect their advancement. In this regard in the embodiment herein disclosed, it is important that the strip 16 have some type of irregularity either in the surface or edges thereof which may be defined by the individual labels 17 or otherwise so that the fingers 84 will engage the strip 16 to effect its advancement rather than slide over the strip surface. Examples of this type of strip construction (although shown as printed strips) are illustrated in FIGS. 9 through 15. The fingers 84 are mounted on blocks 86 which are adjustably positioned on a lateral rod 88 which extends between adjustable slide blocks 90. The blocks 90 travel on guide rods 92 which guide the fingers 84 in their reciprocal movement as they advance the labels 17 while guide blocks 94 and 96 laterally retain the strip 16 as it is advanced to the printing station 18. Reciprocal sliding movement of the fingers 84 is effected with a vertical linkage arm 98 which extends from one of the blocks 90 and is pivotally attached to a pivot arm 100. The arm 100 is pivotally attached to an eccentric 102 and thereby operates to effect reciprocal movement of the arm 98 and the blocks 90 as the eccentric 102 is rotated. The eccentric 102 is mounted on a shaft 104 which is mechanically connected to the motor 78 through the gear box 80; and in this manner rotation of the eccentric 102 is effected to reciprocally move the fingers 84 to advance the label strip 16. Furthermore, since the feed assembly 13 is mechanically driven by the motor 78, proper gearing of the shafts 76 and 104 in the gearbox 80 provides positive coordination between the movement of the printing assembly 12 and the feed assembly 13 so that the labels 17 are always stationary and properly positioned when the printing head 40 descends at the station 18.

The thermographic feed assembly 14 operates to stepwisely advance the thermographic strip 20 which comprises a conventional thermographic strip of colored metallic foil and integrated heat sensetive adhesive on Mylar backing to the printing station 18. The strip feed assembly 14 includes a strip feed roll 108 which is mounted on a shaft 110 attached to a collapsible bracket 112 which extends from the front of the housing 21. The strip 20 extends from the roll 108, over a guide roll 114 to the printing station 18 overlaying the label strip 16 and extending rearwardly through the apparatus 10 to a knurled drive roll 116 and a rubber nip roll 118. The rolls 116 and 118 are mounted in slightly pressurized engagement on a bracket 120 attached to the plate 26 and cooperate to advance the spent strip 20 by grasping it as it is fed therebetween. After passing between the rolls 116 and 118, the strip 20 is wound on a take up roll 124 mounted in alignment above the rolls 116 and 118 with a bracket 126. The rolls 116, 118 and 124 are simultaneously stepwisely rotated with the drive assembly 15 to effect advancement and take up of the strip 20. In this connection bevel gears 128 communicate rotation from the shaft 76 to a primary strip drive shaft 130 which communicates with a secondary strip drive shaft 132 through a drive chain 134 and sprockets 136. The primary and secondary strip feed shafts 130 and 132 are mounted in the assembly 10 with suitable conventional means (not shown) and effect stepwise rotation of the rolls 116, 118 and 124 through an eccentric 138 having a pawl arm 140 eccentrically mounted thereon. Upon rotation of the secondary shaft 132 substantially horizontal reciprocal movement of the pawl arm 140 is effected to provide stepwise rotation of a drive roll shaft 142 and the drive roll 116 mounted thereon through a ratchet gear 144. A housing 154 covers the eccentric 138, the pawl arm 140 and the gear 144. Stepwise rotation is communicated from the drive roll shaft 142 to the roll 118 through the intimate contact between the rolls 116 and 118 and to the take up roll 124 through a chain 146 and lower and upper sprockets 148 amd 149. The chain 146 and the sprockets 148 and 149 are disposed within a gear housing 150 and drive a take up roll drive shaft assembly 151 extending from the take up roll 124.

Figure 5:
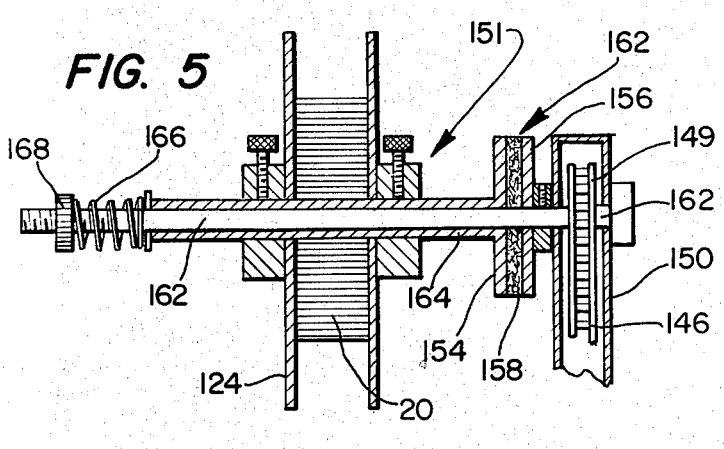
FIG. 5 is a sectional view taken along line 5—5 in FIG. 1.

The take up roll shaft assembly 151 and the take up roll 124 are most clearly illustrated in FIGS. 4 and 5. As will be seen, as the strip 20 is gradually wound on the take up roll 124, the winding diameter gradually increases; and accordingly, the amount of rotation of the roll 124 required to take up the spent strip 20 as it is fed thereto by the rolls 116 and 118 correspondingly decreases. In order to compensate for the winding diameter on the roll 124 as the strip 20 is progressively wound thereon, the take up roll shaft assembly 151 includes a slip clutch assembly 162 comprising a pair of spaced clutch discs 154 and 156 with a fiberous pad 158 therebetween. A boss 160 extends from the plate 156 and is securely mounted on an inner shaft 162 extending from the sprocket 149. A tubular member 164 extends from the plate 154 and is free to rotate on the shaft 162 being laterally retained thereon with a spring 166 and a nut 168 and the roll 124 is securely mounted on the tubular member 164. Accordingly, as the shaft 162 is rotated, relative slippage between the plates 154 and 156 is effected through the pad 158 to provide even tension on the strip 20 throughout the winding operation and to compensate for the varying amount of rotation of the roll 124 necessary for take up as the strip 20 is progressively wound thereon.

Figure 3:
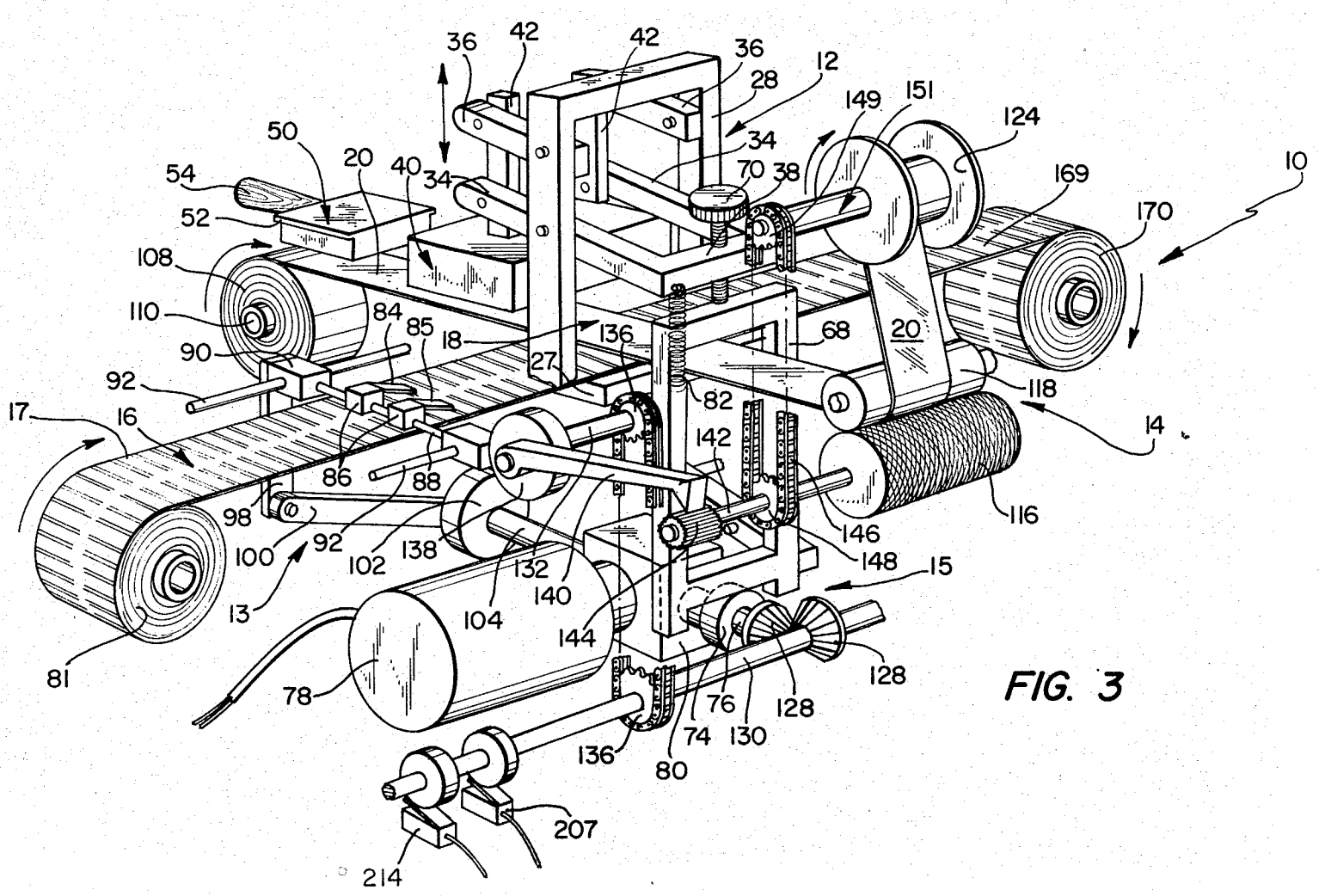
FIG. 3 is a rear schematic perspective view of the apparatus.

After printing of the labels 11 at the printing station, they are alternatively wound as a continuous strip of printed labels 169 onto a take up roll assembly 170 as illustrated in FIG. 3 or cut into individual printed labels with a cutter assembly 172. In this connection the assemblies 170 and 172 are alternatively mountable on the base 21 for receiving the printed labels 169 as they are advanced from the printing station 18 by the label feed assembly 13. The take up roll assembly 170 includes a take up wheel 174 which is rotatably mounted on a mounting arm 176 which is attachable to a bracket 178 on the base 21. Conventional means (not shown) including a drive belt and a drive pulley designed for intentional slippage at a predetermined tension level communicates rotation to the wheel 174 from the drive assembly 18 providing even tension as the strip of printed labels is progressively wound thereon.

Figure 6:
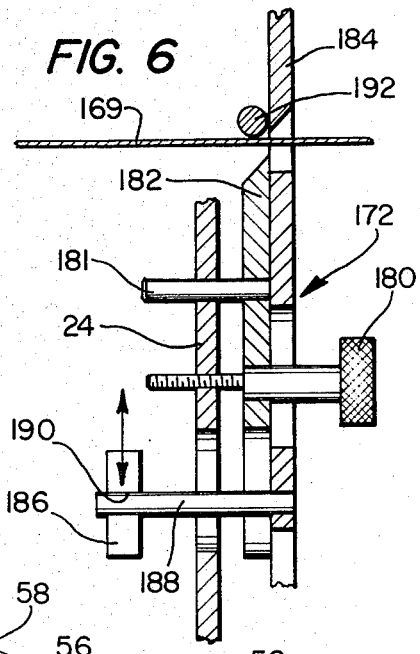
FIG. 6 is a sectional view taken along line 6—6 in FIG. 2.

The cutter assembly 172 which is mountable on the base 21 in place of the take up roll assembly 170 is illustrated most clearly in FIGS. 2 and 6. As shown, the cutter assembly 172 is mountable on the base 21 and has a knurled thumb screw 180 and a registration pin 181 secured thereto. The cutter assembly 172 further includes stationary and sliding cutting blades 182 and 184 respectively which act to cut the strip 16 into individual labels 17 with a guillotine-like action. The assembly 172 is driven by the drive assembly 15 through a drive arm 186 which extends forwardly in generally horizontal disposition from the lower portion of the frame 68 and therefore moves in an up and down manner as the cam 74 is rotated. Communication between the arm 186 and the sliding blade 184 is provided by a transverse drive pin 188 which extends from the lower portion of the blade 184 and is receivable in a hole 190 in the arm 186, so that the arm 186 operates to reciprocally move the blade 184 up and down to effect the cutting operation. In this connection a roller guide 192 and side brackets 194 assure proper positioning of the strip and the blades 182 and 184 during the cutting operation. As will be seen from FIG. 6, the assembly 172 is adjustably positioned in slightly outwardly spaced relation from the base 21 to permit adjustment for cutting different sized labels 17.

Operation of the apparatus 10 is effected with various controls mounted on a control housing 194 which extends forwardly from the base 21. Included in the embodiment herein disclosed are a counter 196, a heater switch 198, a counter switch 200, a heater control 202, a power light 204 and a fuse 206 all of which are attached to the housing 194 and which are operatively connected to their respective elements within the apparatus 10. In this connection the counter operates through a cam actuated switch 207 to count the up and down cycles of the printing assembly 12. A speed control 208, a power switch 210 and a main fuse 212 are attached to the base 21 and are similarly operatively connected to their respective elements. In this regard, however, the power switch 210, operates to energize the drive motor 80 through a cam actuated switch 214 shown in FIGS. 3 and 4. Upon deactivation of the apparatus 10 with the switch 210, the switch 214 causes the apparatus 10 to complete its printing cycle so that the print head 42 stops in its upper position to allow removal or replacement of the chase 50, the strip 20 or the label strip 16.

It is seen therefore that the thermographic printing apparatus herein disclosed is effective for high resolution thermographic printing operations. The parallel linkage printing assembly 12 operates to assure that the print head 40 is always substantially parallel to the printing pad 27 during printing to permit high character resolution on various types of labels as illustrated in FIGS. 9 through 15. Furthermore, the direct mechanical connection of the printing assembly 12, the label feed assembly 13 and the thermographic strip feed assembly 14 as they are driven by the drive assembly 15 provides highly coordinated movement of the elements within the apparatus 10 to assure proper label positioning and thermographic strip movement. For these reasons, the apparatus 10 represents a significant development in the art of thermographic label printers which is of substantial commercial significance.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. An apparatus for printing a succession of labels, tags or the like comprising:

a. a base;

b. a printing pad mounted on said base;

c. a printing frame attached to said base and extending substantially upwardly therefrom;

d. a primary linkage arm pivotally attached to said frame, said primary arm including front and rear arm portions which extend forwardly and rearwardly respectively, the forwardly extending portion of said primary arm extending generally above said pad;

e. a secondary linkage arm pivotally attached to said frame, said secondary linkage arm being pivotal in substantially the same plane as said primary linkage arm and including a front arm portion that extends forwardly and that extends generally above said pad in substantially parallel spaced relation to said primary arm;

f. a print head;

g. means pivotally attached to the front arm portions of said primary and secondary arms and disposed generally above said pad for mounting said print head so that upward and downward pivotal movement of the rear portion of said primary arm moves said print head correspondingly to and from said pad in substantially parallel relation thereto;

h. a type element on said head directed toward said pad;

i. means attached to said head for heating said type element;

j. a cam element rotatably mounted on a substantially horizontal axis in the rear portion of said apparatus;

k. driven means for rotating said cam element;

l. a substantially vertically disposed cam follower frame which travels in a substantially vertical plane to provide mechanical communication between said rear arm portion and said cam element to cyclically move said rear arm portion up and down upon rotation of said cam element and to thereby cyclically reciprocate said head to and from said pad, said frame having a central aperture therein which is disposed in substantially aligned relation behind said pad;

m. means mechanically connected to said drive means for stepwisely advancing a succession of labels, tags or the like in aligned relation to said pad during the cyclical periods of said print head when said head is in spaced relation to said pad;

n. a thermographic strip interposed between said type element and the label, tag or the like at said pad; and o. a strip feed assembly mounted in said apparatus to the rear of said frame and mechanically connected to said drive means for stepwisely advancing said thermographic strip rearwardly in substantially perpendicular relation to the movement of said labels, tags or the like, said strip feed assembly advancing said strip so that it moves rearwardly in said apparatus from said pad through the aperture in said frame without interference from said frame as it is reciprocated.

2. In the apparatus of claim 1, said frame further characterized as providing adjustable communication between said cam element and said rear arm portion to adjust the extent of the upward travel of said rear arm portion and thereby adjust the extent of the downward travel of said head.

3. The apparatus of claim 1, further comprising an adjustment screw which provides interengagement between the upper end of said frame and said rear arm portion to effect communication therebetween and which is adjustable to alter the extent of the upward travel of said rear arm portion and thereby alter the extent of the downward travel of said head.

4. The apparatus of claim 3, further comprising means biasing said rear arm portion toward said frame to provide biased interengagement therebetween with said adjustment screw.

5. In the apparatus of claim 1, said frame further characterized as an elongated rectangular frame having an elongated rectangular opening therein to provide clearance for said strip as said frame is reciprocated.

6. In the apparatus of claim 1, said strip feed assembly comprising:

a. a strip drive roller mounted in said apparatus to the rear of said frame and in alignment with the aperture therein and with said pad, said drive roller being mechanically connected to said drive means for stepwise rotation during the periods when said print head is in spaced relation to said pad; and b. a strip nip roller mounted in said apparatus to the rear of said frame in slightly pressurized communication with said strip drive roller, said strip passing between said strip nip and drive rollers, whereby said strip nip and drive rollers cooperate to stepwisely advance said strip rearwardly in said apparatus.

* * * * *